US007572994B2

(12) United States Patent
Jung

(10) Patent No.: US 7,572,994 B2
(45) **Date of Patent: *Aug. 11, 2009**

(54) KEYPAD AND METHOD FOR FABRICATING SAME

(75) Inventor: Sun-Tae Jung, Anyang-si (KR)

(73) Assignee: Samsung Electronics Co., Ltd., Yeongtong-Gu, Suwon-Si, Gyeonggi-Do (KR)

( * ) Notice: Subject to any disclaimer, the term of this patent is extended or adjusted under 35 U.S.C. 154(b) by 76 days.

This patent is subject to a terminal disclaimer.

(21) Appl. No.: 11/592,931

(22) Filed: Nov. 3, 2006

(65) Prior Publication Data

US 2007/0125634 A1 Jun. 7, 2007

(30) Foreign Application Priority Data

Dec. 5, 2005 (KR) ..... 10-2005-0117728

(51) Int. Cl.
*H01H 9/00* (2006.01)

(52) U.S. Cl. ..... 200/310

(58) Field of Classification Search ..... 200/5 A, 200/512–517, 314, 310

See application file for complete search history.

(56) References Cited

U.S. PATENT DOCUMENTS

| | | | | |
|---|---|---|---|---|
| 4,262,182 | A | 4/1981 | Basler et al. | 200/314 |
| 4,302,647 | A * | 11/1981 | Kandler et al. | 200/512 |
| 5,128,842 | A | 7/1992 | Kenmochi | 362/95 |
| 5,568,367 | A | 10/1996 | Park | 362/109 |
| 5,666,172 | A * | 9/1997 | Ida et al. | 362/615 |
| 5,718,497 | A * | 2/1998 | Yokoyama et al. | 362/625 |
| 2003/0103359 | A1 | 6/2003 | Chiang et al. | |
| 2004/0174331 | A1 | 9/2004 | Su et al. | |
| 2006/0254894 | A1 * | 11/2006 | Jung et al. | 200/314 |
| 2006/0260923 | A1 * | 11/2006 | Lee et al. | 200/314 |
| 2007/0175744 | A1 * | 8/2007 | Lee et al. | 200/314 |

FOREIGN PATENT DOCUMENTS

| | | |
|---|---|---|
| DE | 8510863 | 5/1985 |
| DE | 3628781 | 3/1987 |
| DE | 202004003550 U1 | 8/2004 |
| EP | 0478105 A2 | 4/1992 |
| EP | 1722385 A1 | 11/2006 |
| KR | 10-0651417 B1 | 11/2006 |

* cited by examiner

*Primary Examiner*—Edwin A. Leon
(74) *Attorney, Agent, or Firm*—Cha & Reiter, LLC

(57) ABSTRACT

Disclosed is a keypad and method for fabricating same. The keypad comprises at least one key top, a waveguide having an upper surface on which the key top is disposed and a lower surface on which a plurality of reflective patterns are formed to reflect part of light traveling in the waveguide toward the key top, a lower elastic layer disposed below the waveguide, and an upper elastic layer disposed on top of the waveguide so as to be interposed between the key top and the waveguide.

12 Claims, 4 Drawing Sheets

KEYPAD AND METHOD FOR FABRICATING SAME

CLAIM OF PRIORITY

This application claims the benefit of the earlier filing date, pursuant to 35 USC § 119, to that patent application entitled "Keypad and Method for Fabricating Same," filed with the Korean Intellectual Property Office on Dec. 5, 2005 and assigned Serial No. 2005-117728, the contents of which are incorporated herein by reference.

BACKGROUND OF THE INVENTION

1. Field of the Invention

The present invention relates to a keypad, and more particularly to a keypad having an illumination means and a method for fabricating same.

2. Description of the Related Art

Generally, mobile terminals have an illumination means which emits light to enable the users to use a keypad in the dark. The illumination means can have a structure that disposes a plurality of light emitting diodes on a PCB (Printed Circuit Board) or a structure that inserts an inorganic electro-luminescence element into an elastic pad.

FIG. 1 is a view illustrating a conventional keypad assembly 100 with a plurality of light emitting diodes. The keypad assembly 100 includes a switch board 150, a plurality of light emitting diodes (LEDs) 170 and a keypad 110.

The keypad 110 includes a plate-shaped elastic layer 120 which is made from a rubber material, a plurality of key tops 140 disposed on a first surface 122 of the elastic pad 120 and imprinted with numbers and characters, and a plurality of protrusions 130 projected downwardly from a second surface 124 of the elastic pad 120. The protrusions 130 are centrally disposed below the corresponding key tops 140. Also, the elastic pad 120 has a plurality of grooves 126 on the second surface 124 thereof so that the plurality of LEDs 170 can be inserted into the grooves 126.

The switch board 150 includes a switch sheet placed on top of a printed circuit board (PCB) 155. The switch sheet has a plurality of switches 160 on the top thereof. Each switch 160 consists of a conductive contact member 162 and a conductive dome 164 that completely covers the contact member 162. In addition, the LEDs 170 are mounted on the switch sheet.

In the prior art, a keypad assembly having a keypad with an inorganic electro-luminescence element inserted into an elastic layer has also been suggested. However, a separate AC power is needed to use the inorganic electro-luminescence element. In other words, conventional keypad assemblies including inorganic electro-luminescence element further include a separate inverter for converting a DC (direct current) voltage into an AC (alternating current) voltage, which increases the size and manufacturing cost of the keypad assembly and complicates the keypad assembly fabricating process.

SUMMARY OF THE INVENTION

Accordingly, the present invention has been made to solve the above-mentioned problems occurring in the prior art and provides additional advantages, by providing a method for fabricating a keypad which can emit light of uniform intensity with reduce manufacturing cost.

In one embodiment, there is provided a method for fabricating a keypad, comprising the steps of forming an optical fiber sheet having at least two optical fiber arrays and a plurality of grooves, forming a key sheet having at least two key patterns corresponding respectively to the at least two optical fiber arrays and a plurality of projected alignment pins, the alignment pins corresponding respectively to the grooves, attaching an upper elastic layer onto the optical fiber sheet, mounting the key sheet on the upper elastic layer so that the alignment pins can penetrate the upper elastic layer to be inserted into the corresponding grooves of the optical fiber sheet, cutting the key sheet with the aligned upper elastic layer and optical fiber sheet into at least two pieces according to the key patterns, and attaching a lower elastic layer having projections to a bottom surface of each piece cut out according to the key patterns.

BRIEF DESCRIPTION OF THE DRAWINGS

The above features and advantages of the present invention will be more apparent from the following detailed description taken in conjunction with the accompanying drawings, in which.

DETAILED DESCRIPTION

Hereinafter, exemplary embodiments of the present invention will be described with reference to the accompanying drawings. For the purposes of clarity and simplicity, a detailed description of known functions and configurations incorporated herein will be omitted as it may make the subject matter of the present invention unclear.

Figure 2:
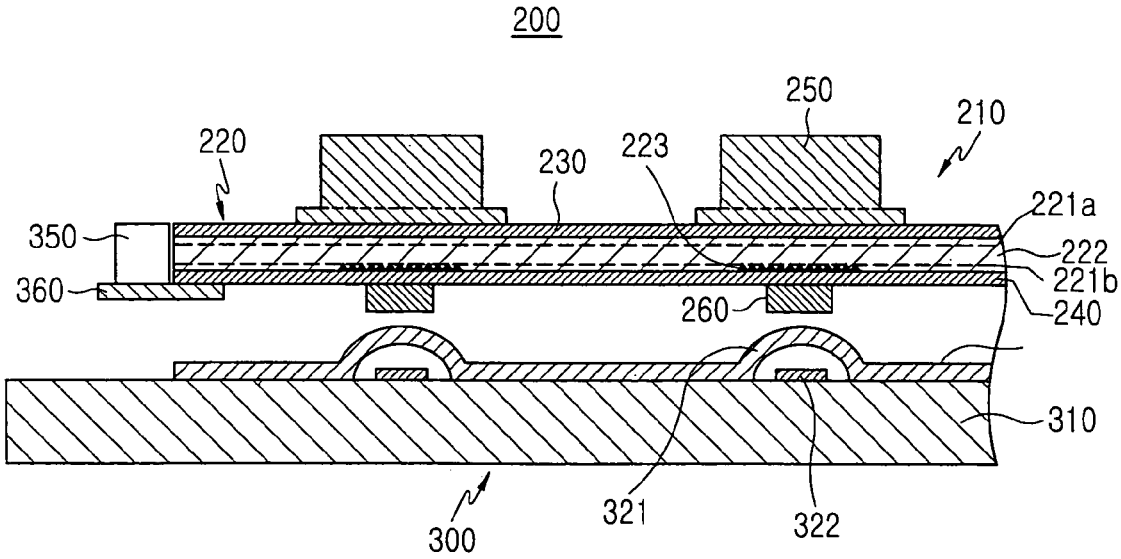
FIG. 2 is a view illustrating a keypad assembly having a keypad with a waveguide.

FIG. 2 is a view illustrating a keypad assembly having a keypad with a optically-transparent waveguide. Referring to FIG. 2, the keypad assembly 200 includes a keypad 210 including an illumination means 350 and at least one key top 250, a switch board 300 placed below the keypad 210 to form an electric contact point according to the operation of each key top 250, a printed circuit board 360, and at least one light source 350.

The keypad 210 includes a waveguide 220 and key tops 250 disposed on top of the waveguide 220. A plurality of reflective patterns 223 are formed on a lower surface of the waveguide 220 to reflect part of the light traveling in the waveguide 220 toward the key tops 250. The keypad 210 also includes a lower elastic layer 240 formed below the waveguide 220 and an upper elastic layer 230 formed on an upper surface of the waveguide 220. The upper elastic layer 230 is interposed between the key tops 250 and the waveguide 220.

The waveguide 220 includes a core 222 and clads 221*a* and 221*b* formed respectively on top and bottom of the core 222. The reflective patterns 223 for reflecting part of the light traveling in the core 222 toward the key tops 250 are formed on the lower clad 221*b*.

In order to uniformly illuminate the overall key tops regardless of the distance from the light source, the reflective patterns 223 provided below the key tops relatively close to the light source may have a lower density than those provided below the key tops remote from the light source.

The printed circuit board 360 is attached to an end portion of the lower elastic layer 240. At least one light source 350 is mounted on top of the printed circuit board 360 in such a manner that its light emitting side can face a lateral side of the waveguide 220. Light emitted from the light source 350 is combined into the interior of the waveguide 220 through the lateral side of the waveguide 220. The printed circuit board 360 can be a flexible printed circuit board (FPCB). Also, a general UV emitting diode can be used as the light source 350.

Figure 1:
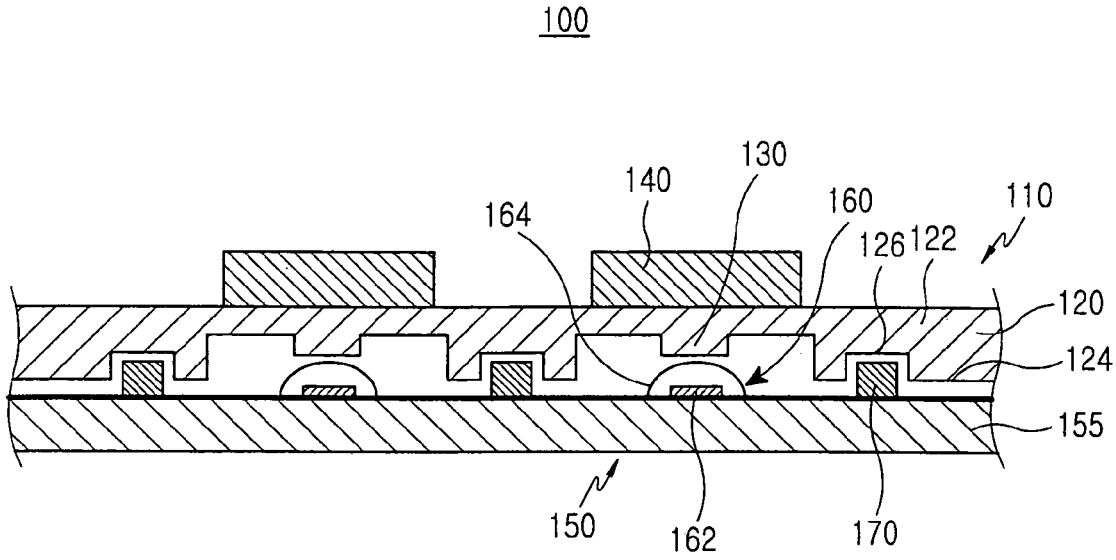
FIG.1 (PRIOR ART)
FIG. 1 is a view illustrating a conventional keypad assembly.

The switch board 300 is similar to switch board 150 shown in FIG. 1 and consists of substrate 310, a conductive contact member 322 and a conductive dome 321 that completely covers the contact member 322.

FIGS. 3A through 3E are views illustrating a process for fabricating a keypad according to a preferred embodiment of the present invention. The process comprises the steps of forming an optical fiber sheet 310 having a plurality of optical fiber arrays 312*a*, 312*b*, 312*c* and 312*d*, forming a key sheet 320 (see FIG. 3B) attaching an upper elastic layer 330 (see FIG. 3C) onto the optical fiber sheet 310, attaching a lower elastic layer 340 (see FIG. 3D) having a plurality of projections 341 and 342 corresponding to the optical fiber arrays 312*a*, 312*b*, 312*c* and 312*d* (see FIG. 3B) to a lower surface of the optical fiber sheet 310 (see FIG. 3A) and aligning at least two secondary holes 322*a* and 322*b* formed on the key sheet 320 (see FIG. 3B) to fit with primary holes 311*a* and 311*b* formed on the optical fiber sheet 310 (see FIG. 3A) and placing the key sheet 320 (see FIG. 3B) on top of the upper elastic layer 330 (see FIG. 3C).

Figure 3A:
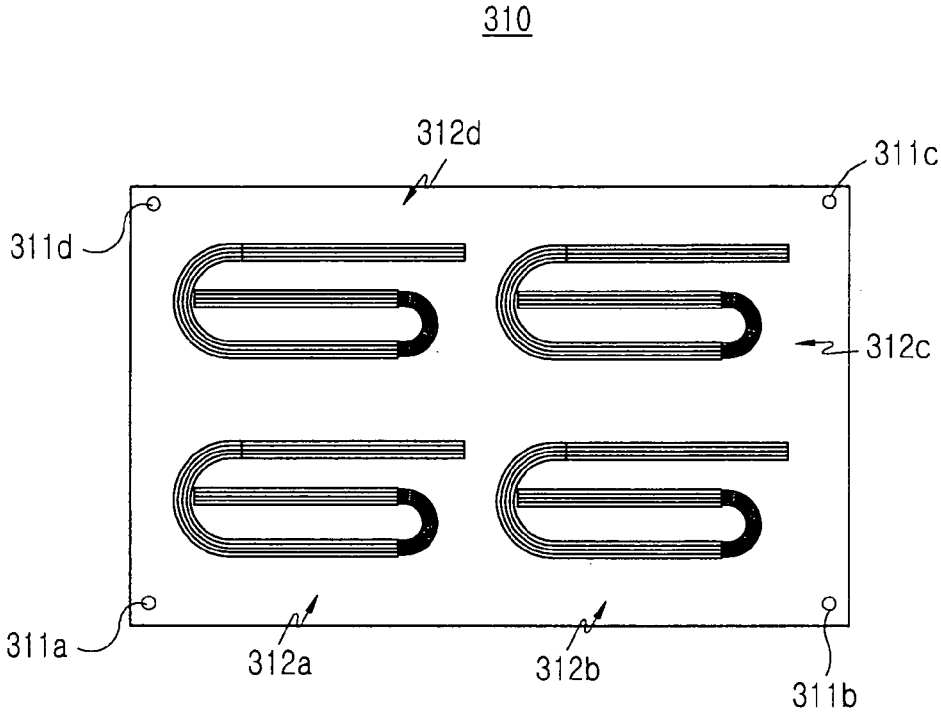
FIGS. 3A through 3E are views illustrating a process for fabricating a keypad according to a preferred embodiment of the present invention.
Figure 3B:
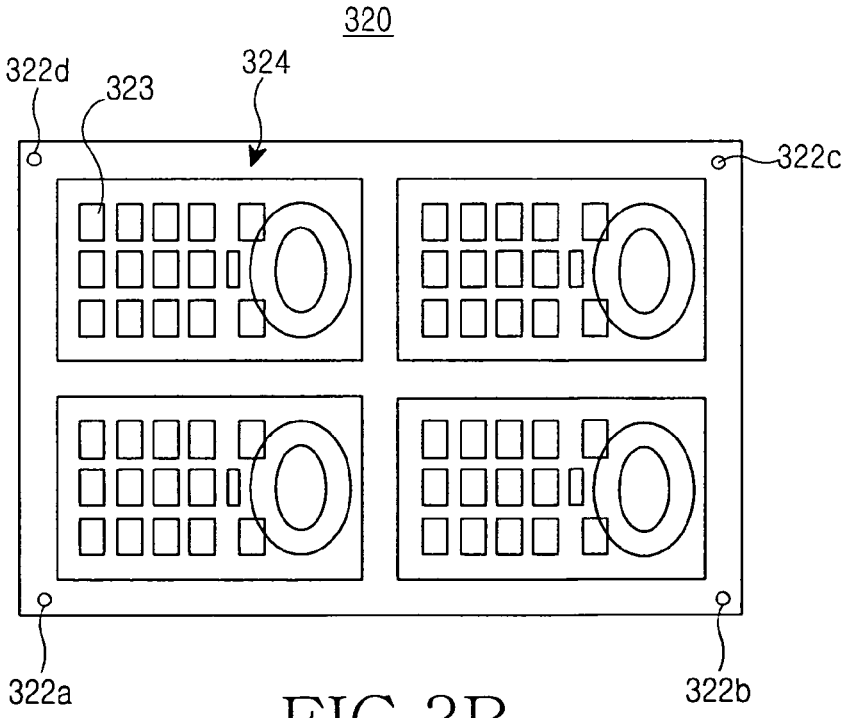

Referring to FIG. 3A, the optical fiber sheet 310 is formed to have at least two optical fiber arrays 312*a*, 312*b*, 312*c* and 312*d* disposed in a shape corresponding to the key patterns 324 shown in FIG. 3B. The optical fiber sheet 310 also has primary holes 311*a*, 311*b*, 311*c* and 311*d* used for alignment. A plurality of reflective patterns (not shown) are formed on each optical fiber array 312*a*, 312*b*, 312*c* or 312*d* of the optical fiber sheet 310.

Referring to FIG. 3B, the key sheet 320 is formed to have key patterns 324 corresponding respectively to the optical fiber arrays 312*a*, 312*b*, 312*c* and 312*d* (FIG. 3A). The key sheet 320 also has secondary holes 322*a*, 322*b*, 322*c* and 322*d* corresponding respectively to the primary holes 311*a*, 311*b*, 311*c* and 311*d*. The key sheet 320 can be formed, for example, by the well-known process of injection molding. Each key pattern 324 includes at least one key top 323. The secondary holes 322*a*, 322*b*, 322*c* and 322*d* are formed to fit respectively with the primary holes 311*a*, 311*b*, 311*c* and 311*d*.

Figure 3C:
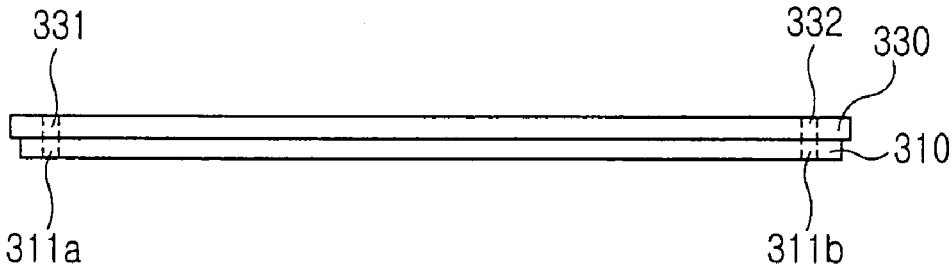

FIG. 3C illustrates a step of attaching an upper elastic layer 330 onto the optical fiber sheet 310. The upper elastic layer 330 can also be formed by injection molding. A plurality of tertiary holes 331 and 332 corresponding respectively to the primary holes 311*a*, 311*b*, 311*c* and 311*d* are formed on the upper elastic layer 330. The upper elastic layer 330 is attached onto the optical fiber sheet 310 in such a manner that the tertiary holes 331 and 332 fit with the corresponding primary holes 311*a* and 311*b* respectively.

Figure 3D:
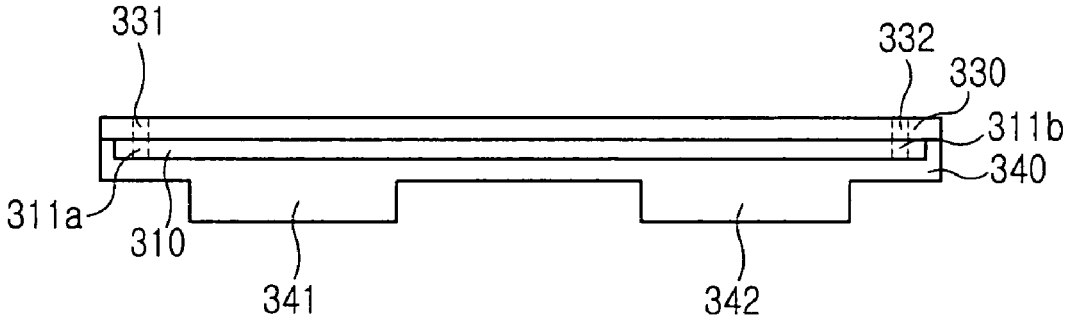

FIG. 3D illustrates a step of attaching a lower elastic layer 340 having projections 341 and 342 to the lower surface of the optical fiber sheet 310 with the upper elastic layer 330 attached to the upper surface thereof. Referring to FIG. 3D, the lower elastic layer 340 is attached to the lower surface of the optical fiber sheet 310. In other words, the optical fiber sheet 310 is mounted on top of the lower elastic layer 340. The lower elastic layer 340 has at least two projections 341 and 342 corresponding to the optical fiber arrays 312*a*, and 312*b*, respectively at a lower surface thereof.

Figure 3E:
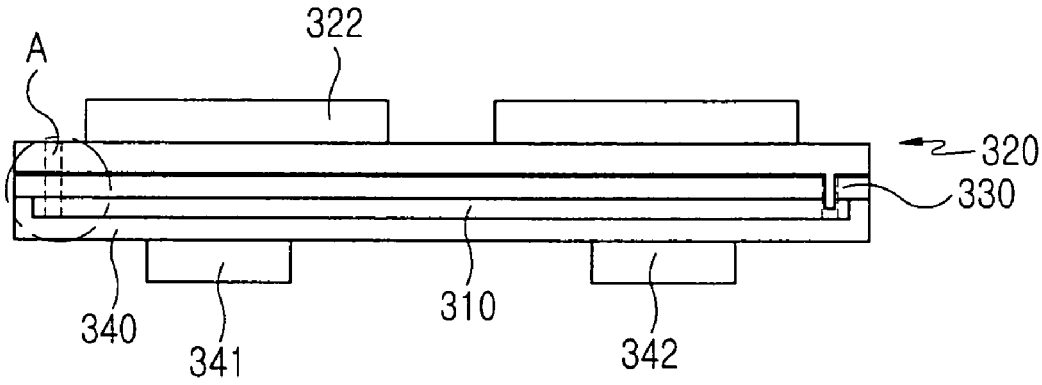
Figure 4:
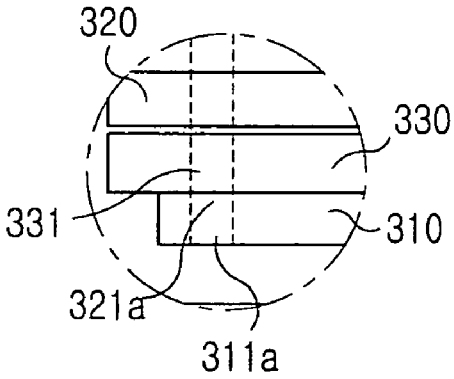
FIG. 4 is an enlarged view of part "A" in FIG. 3*e*.

FIG. 4 is an enlarged view of part "A" in FIG. 3E. As illustrated in FIG. 3E, the key sheet 320 is disposed on the upper elastic layer 330 in such a manner that the key patterns 324 can correspond to the respective optical fiber arrays 312*a*, 312*b*, 312*c* and 312*d* of the optical fiber sheet 310 and that the primary holes 311*a*, 311*b*, 311*c* and 311*d* can fit with the corresponding secondary and tertiary holes 322*a*, 322*b*, 322*c*, 322*d*, 331 and 332. An external alignment means (not shown) is inserted into the first through tertiary holes, thereby securing the alignment of the holes.

According to another embodiment of the present invention, the optical fiber sheet 310 can be attached onto the upper elastic layer 330. Alternatively, it is also possible to form a silicon material on the upper elastic layer 330 and then attach the optical fiber sheet 310 onto the silicon material. The key sheet with the aligned upper elastic layer and optical fiber sheet as illustrated in FIG. 3E is cut according to the key patterns 324 to form a plurality of keypads.

As explained above, a plurality of keypads are fabricated at once using a waveguide. The waveguide for guiding light toward the key tops of each keypad is inserted into an elastic layer, which improves efficiency in the manufacture of the keypads and prevents thermal damage to the optical fiber arrays. The keypad fabricating process according to the present invention is much simpler than a conventional process. In addition, a keypad fabricated using a waveguide according to the present invention can backlight the key tops in a uniform intensity of illumination.

Although preferred embodiments of the present invention have been described for illustrative purposes, those skilled in the art will appreciate that various modifications, additions and substitutions are possible, without departing from the scope and spirit of the invention as disclosed in the accompanying claims, including the full scope of equivalents thereof.

What is claimed is:

1. A keypad comprising:

at least one key top;

a waveguide having an upper surface on which the key top is disposed and a lower surface on which a plurality of reflective patterns are formed to reflect part of a light traveling in the waveguide toward the key top;

a lower elastic layer disposed below the waveguide;

an upper elastic layer disposed on top of the waveguide so as to be interposed between the key top and the waveguide; and a light source for emitting light into a lateral side of the waveguide.

2. The keypad according to claim 1, wherein said waveguide is interposed between the upper elastic layer and the lower elastic layer so that the upper and lower surfaces of the waveguide can contact a lower surface of the upper elastic layer and an upper surface of the lower elastic layer, respectively.

3. The keypad according to claim 1, wherein said reflective patterns are disposed in such a manner that the reflective patterns relatively close to the light source have a lower density than those remote from the light source.

4. The keypad according to claim 1, further comprising a printed circuit board attached to an end portion of the lower surface of the lower elastic layer and having at least one light source mounted on an upper surface thereof in such a manner that a light emitting side of the light source faces a lateral side of the waveguide.

5. The keypad according to claim 1, further comprising:

a switch assembly, oppositely attached to the lower elastic layer, including at least one switch, wherein each of the at least one switch is positioned below a corresponding one of the at least one key top.

6. A method for fabricating a keypad, comprising the steps of:

forming an optical fiber sheet having at least two optical fiber arrays and a plurality of primary holes;

forming a key sheet having at least two key patterns, corresponding respectively to the optical fiber arrays, and a plurality of secondary holes, corresponding respectively to the primary holes;

attaching an upper elastic layer directly onto the optical fiber sheet;

attaching a lower elastic layer having a plurality of projections directly onto a lower surface of the optical fiber sheet; and mounting the key sheet directly onto the upper elastic layer so that the primary holes can fit with the secondary holes.

7. The method according to claim 6, wherein said optical fiber sheet has a plurality of reflective patterns formed on each optical fiber array.

8. The method according to claim 6, further comprising the step of:

attaching a switch assembly, oppositely attached to the lower elastic layer, including at least one switch, wherein each of the at least one switch is positioned below a corresponding one of the at least one key top.

9. The method according to claim 6, wherein said upper elastic layer has a plurality of tertiary holes corresponding to the first and secondary holes.

10. The method according to claim 6, further comprising:

forming a LED lateral to the optical fiber sheet for projecting a light into optical fiber sheet.

11. The method according to claim 10 wherein a density of said plurality of reflective patterns varies based on a distance from the LED.

12. The method according to claim 11, wherein the density of said plurality of reflective patterns increases dependent upon the distance from the LED.

* * * * *